United States Patent [19]

Bantz et al.

[11] Patent Number: 4,679,038

[45] Date of Patent: Jul. 7, 1987

[54] BAND BUFFER DISPLAY SYSTEM

[75] Inventors: David F. Bantz, Chappaqua, N.Y.; Davey L. Malaby, Danbury, Conn.; Paul N. Sholtz, Brewster, N.Y.

[73] Assignee: International Business Machines Corporation, Armonk, N.Y.

[21] Appl. No.: 514,429

[22] Filed: Jul. 18, 1983

[51] Int. Cl.[4] ..... G09G 1/16

[52] U.S. Cl. ..... 340/721; 340/747; 340/750; 340/799

[58] Field of Search ..... 340/721, 747, 750, 798, 340/799, 745

[56] References Cited

U.S. PATENT DOCUMENTS

| | | | |
|---|---|---|---|
| 3,925,776 | 12/1975 | Swallow | 340/747 |
| 3,999,168 | 12/1976 | Findley et al. | 340/172.5 |
| 4,005,390 | 1/1977 | Findley | 340/172.5 |
| 4,090,260 | 5/1978 | Sinobad | 365/237 |
| 4,093,996 | 6/1978 | Hogan et al. | 364/900 |
| 4,094,000 | 6/1978 | Brudevold | 364/900 |
| 4,129,858 | 2/1978 | Hara | 340/324 |
| 4,146,879 | 3/1979 | Nicholson et al. | 340/734 |
| 4,149,145 | 4/1979 | Hartke et al. | 340/739 |
| 4,199,757 | 4/1980 | Ichimi | 340/750 |
| 4,200,869 | 4/1980 | Murayama et al. | 340/723 |
| 4,205,310 | 5/1980 | McMann, Jr. et al. | 340/750 |
| 4,217,577 | 8/1980 | Roe et al. | 340/703 |
| 4,232,376 | 11/1980 | Dion et al. | 340/750 |
| 4,237,543 | 12/1980 | Nishio et al. | 364/900 |
| 4,241,341 | 12/1980 | Thorson | 340/747 |
| 4,246,578 | 1/1981 | Kawasaki et al. | 340/750 |
| 4,250,502 | 2/1981 | Klauck et al. | 340/728 |
| 4,258,361 | 3/1981 | Hydes et al. | 340/721 |
| 4,342,051 | 7/1982 | Suzuki et al. | 358/283 |
| 4,367,533 | 1/1983 | Wiener | 364/519 |
| 4,404,554 | 9/1983 | Tweedy, Jr. et al. | 340/747 |
| 4,442,503 | 4/1984 | Schütt et al. | 340/747 |
| 4,447,809 | 5/1984 | Kodama et al. | 340/747 |
| 4,454,507 | 6/1984 | Srinavasan | 340/747 |
| 4,587,559 | 5/1986 | Longacre, Jr. et al. | 340/750 |

OTHER PUBLICATIONS

*Video Display Processor Simulates Three Dimensions*, Guttag et al; Electronics; vol. 53, #25, pp. 123–126, 11/80.

D. A. Canton, "Implementation of Refresh Memory in Microprocesor-Controlled Displays", IBM TDB, vol. 25, No. 2, Jul. 1982, p. 843.

P. A. Beaven et al, "Programmable Symbols Technique for Raster-Scanned Display", IBM TDB, vol. 25, No. 2, Jul. 1982, p. 844.

*Primary Examiner*—Marshall M. Curtis

*Attorney, Agent, or Firm*—Carl C. Kling

[57] ABSTRACT

Pixel representations for each of a plurality of superimposed (or splitscreen) display portions are accumulated in a band buffer prior to being transferred to the display. The actual pixel representations are made available to the band buffer from an image memory, with addresses provided by a display list memory. This system minimizes the need for buffering and high speed storage to service the video, by addressing first the display list memory, then in turn using the content of the display list memory to address the image storage, and then in turn using the content of the image storage as the actual pixel representations for accumulation in the band buffer. Two band buffers operate alternatively. The current band buffer is feeding a band of pixel representations to the video shift register while the next band buffer is accumulating the pixel representations of the subsequent video display band. The band buffer accumulates actual pixel representations equivalent to the related band of the display. The pixel representations sent to the band buffer from image memory are gated by controls which ensure that the proper pixel prevails in the case of a composite display made up of a primary display with a secondary display which might have higher priority, as, for example, a text announcement superimposed over a normal entertainment program image.

4 Claims, 14 Drawing Figures

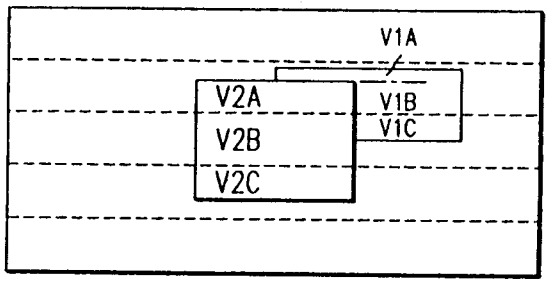
FIG. 8.1
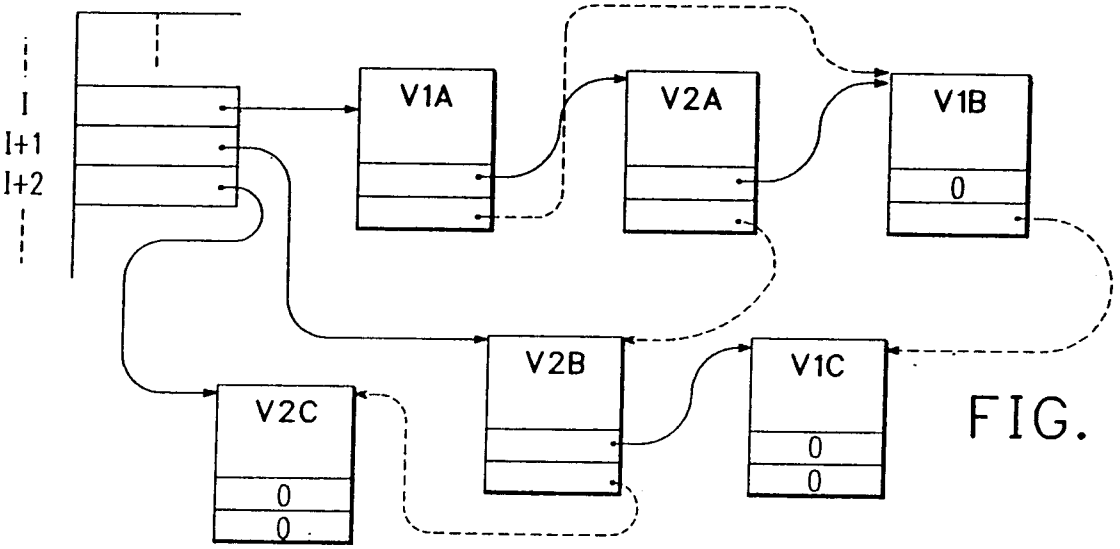
FIG. 8.2

BAND BUFFER DISPLAY SYSTEM

BACKGROUND OF THE INVENTION

1. Field of the Invention

This invention relates to visual display devices, and more particularly relates a repetitive copy system into to a band buffer for economical synthesis of subimages of actual pixel representations of a composite display of superimposed coded or uncoded images.

DESCRIPTION OF THE PRIOR ART

Buffering schemes are well known in the context of video displays as well as in computer systems. Webster's new Collegiate Dictionary defines buffer in the context of this invention as "a temporary storage unit (as in a computer); esp: one that accepts information at one rate and delivers it at another."

The vast amount of picture element (pixel) representations required to support a video display, particularly a multi-viewport composite video display in which two or more separate pictures appear simultaneously on the same video screen (split screen or picture inset, etc.) requires buffering in most cases involving a computer. Each pixel may require a substantial number of binary bits to provide a complete pixel representation, especially in color systems. A large buffer may be required because the display pixel representation stream forwarding rate may differ significantly from the rate at which information for a particular viewport is generated by the computer for accumulation in the buffer. Character information, for example, may very well arrive several bits in parallel but at relatively low speed as contrasted to the high speed serial forwarding of pixel representations to the video raster.

It is known to provide a double raster memory, in effect two buffers, to provide a multi-viewport superimposed picture. The double raster memory technique requires a significant amount of storage and related circuitry and is expensive as a result.

Techniques for developing a second viewport display with less than a full double raster memory include techniques for partitioning the image and utilizing separate registers or small memories for storing designated portions of the image. One such technique is to accumulate the image by segments and unload the segments into a shift register which drives the video circuitry. Another technique is to provide separate line buffers which are alternately read and stored to generate consecutive lines of data to be displayed.

The prior art discloses the broad concept of generating complex video data and storing such data in various types of buffers. The demand for storage, however, is such that the costs of straightforward segment buffering may be prohibitive. A sophisticated approach which provides for the multi-viewport composite display, with a minimum of buffer usage, and therefore with a minimum cost, is a known requirement.

A key technical problem in the design of the display controller and display generator is to allow update of the displayed picture quickly when either the content of an application's graphical window changes or the arrangement of viewports in the picture changes. This problem is especially difficult when the graphical entities to be displayed include images, line drawings, and multi-font proportionally spaced characters, all in color.

One solution to the problem, when the graphical entities are restricted to fixed pitch characters with fixed line spacing, is to use a conventional character generator and to manage the character buffer entirely with software in a display controller processor. This solution may suffice if the complexity of the program that the display control processor executes is relatively low. When the graphical entities to be displayed include variable-size characters at arbitrary positions, with both image and graphics, a common solution is to assemble a one-bit-per-pixel representation of the picture in a bit buffer. This solution is often inadequate because the complexity of the program in the display control processor is high, and the number of instructions necessary to update the bit buffer is high and the rate at which the bit buffer can be updated is correspondingly limited.

In an effort to improve the adequacy of this solution, a known solution is a high speed copy operation from one rectangular area in the bit buffer to another. The bit buffer can be extended to contain a nondisplayable region which contains character fonts. Building an image, then, consists of the display controller specifying a series of copy operations from the nondisplayable region to the displayable region: the image can be modified by either copying within the displayable region or by rebuilding the image. The Xerox Alto system, for example, carries out this solution in a hardware addition called the BITBLT operator.

This solution is often adequate, but for simple modifications of complex images the image update time may still be too long. One source of this time is the memory access time of the bit buffer. Typically, even for high resolution displays (768 by 960 pixels) the required access time to support refresh at 60 Hz is 400 nanoseconds, so that each copy operation takes at least 800 nanoseconds. Additionally, the time necessary to determine the parameters of the copy operation and to sequence it must be added. The image distorts as the copy from a non-displayable to a displayable region is done. Extensions to color are possible, but reduce performance. Finally, when some area is moved from a displayable region to another displayable region, the region vacated must be erased. If only part of the information is to be moved, say from a region in which several sources of information have been superimposed, the only general solution is to rebuild the picture.

LISTING OF PRIOR ART

U.S. Pat. No. 4,005,390, Findley, MERGER AND MULTIPLE TRANSLATE TABLES IN A BUFFERED PRINTER, January 1977. Findley uses two line buffers which alternately load and print. Findley uses an intermediate buffer, a page buffer and a modification data buffer in addition to the two line buffers.

U.S. Pat. No. 4,093,996, Hogan et al, CURSOR FOR AN ON-THE-FLY DIGITAL TELEVISION DISPLAY HAVING AN INTERMEDIATE BUFFER AND A REFRESH BUFFER, June 1978. Hogan et al stores partial rasters for assembly storage of data and of address. An intermediate buffer is used to hold a conic section of six 32 bit words, which conic section may appear on several raster lines. The partial raster assembly store is a high-speed memory with capacity for two or three full display raster lines in explicit non-coded video dot pattern form.

U.S. Pat. No. 4,094,000, Brudevold, GRAPHICS DISPLAY UNIT, June 1978. Brudevold shows parallel-to-serial conversion and a pair of buffers. Brudevold includes a begin display register which can identify the position on the screen of a display change.

U.S. Pat. No. 4,129,858, Hara, PARTITIONED DISPLAY CONTROL SYSTEM, December 1978. Hara stores the image by partitioned regions. A refresh memory is provided with capacity enough to store the entire CRT display and a special display data memory stores data for a limited specific region. The limited specific region may, for example, be the bottom two lines of the CRT display to be pointed by a light pen.

U.S. Pat. No. 4,149,145, Hartke et al, FAX PROCESSOR, April 1979. Hartke et al shows a horizontal line buffer which accumulates the image by segments and unloads the image segments into a shift register. Hartke et al combines a facsimile processor and a character generator; the character generator provides the character image components while the facsimile processor fills in the rest. Character logic is applied to a horizontal line buffer organized as a ping-pong buffer which accumulates by segments, the data comprising a video signal while concurrently unloading a shift register.

U.S. Pat. No. 4,199,757, Ichimi, CHARACTER DISPLAY APPARATUS, April 1980. Ichimi shows two buffer memories each fed by a dedicated read only memory. Each buffer stores a character and is selectively sampled by a selector circuit to provide that character data to a display memory unit.

U.S. Pat. No. 4,200,869, Murayama et al, DATA DISPLAY CONTROL SYSTEM WITH PLURAL REFRESH MEMORIES, April 1980. Murayama et al shows the use of plural refresh memories each with a dedicated data buffer to provide data for a video signal forming circuit. The video signal forming circuit includes picture element generators and parallel serial converters.

U.S. Pat. No. 4,205,310, McMann Jr., et al, TELEVISION TITLING APPARATUS AND METHOD, May 1980. McMann, Jr. et al shows the use of a stroke memory with first and second auxiliary memory units for use in a television titling apparatus. Each character is formed on a display as a series of strokes during successive scan lines.

U.S. Pat. No. 4,250,502, Klauck et al, RESOLUTION FOR A RASTER DISPLAY, February 1981. Klauck et al presents two character generators each with a dedicated shift register, the shift registers being controlled by a complementary clock so that their outputs, when combined in a mixer, can provide double resolution without increased signal bandwidth.

U.S. Pat. No. 4,232,376, Dion et al., RASTER DISPLAY REFRESH SYSTEM, Nov. 4, 1980, shows a revolver refresh for a raster scan, using a charge coupled device in place of the more expensive frame buffer memory. Changes are inserted dynamically into the revolving video. A random access memory contains X, Y addresses and new values for the pixels which are to be changed. These changes are inserted in the video stream so as to override refresh values of the current video. Dion et al. states "The large, expensive random access memory can be replaced by a large, but much less expensive, charge coupled device (CCD) serial recirculating refresh memory. Then there arises the problem of changing portions or all of the displayed information by changing some or all of the data stored in the CCD recirculating memory." Col 1, lines 20–25. Dion et al. does not accumulate subimages of actual pixel representations, and does not show any analog of the band buffer. Dion et al. does not accumulate the next band of the composite display as a subimage of actual pixel representations.

U.S. Pat. No. 4,241,341, Thorson, APPARATUS FOR SCAN CONVERSION, Dec. 23, 1980, shows vector-to-raster conversion, in real time, from easily-stored calligraphic data to easily-presented raster data by determining points of intersection of a (calligraphic) line segment with a (raster) scan line, with the declared advantage of "... raster scan display without the use of a frame buffer memory ..." Hardware includes mechanism (picture information generator 100, FIG. 1; display file memory 101; and display processor 102) to calculate the intersection points and provide intersection point attributes to scan line buffer memory 103. One scan line buffer memory 700 is filled while another scan line buffer memory 705 is emptied into raster scan device 105, after which the scan buffer memories swap functions for the next line. Thorson does not accumulate the next band of the composite display as a subimage of actual pixel representations.

U.S. Pat. No. 4,258,361, Hydes et al., DISPLAY SYSTEM HAVING MODIFIED SCREEN FORMAT OR LAYOUT, Mar. 24, 1981, shows a mechanism for achieving columnar (side-by-side) split screen display, using a full-raster refresh buffer with address control to split the screen. Hydes et al provides separate layout selection and attribute logic for each column. Hydes et al. follows prior art (shown in Hydes et al. FIG. 1) to the extent of providing compressed data (characters) at the raster-size refresh buffer, then forwards characters to attribute decode logic and refresh logic for expansion to "... sixteen character slices of dots for each character code for display along scan line ... attributes stored with character codes ... determine how characters are displayed." Col 2, lines 49–55. Hydes et al expands on the prior art by providing address selection for the columnar split (Hydes et al FIG. 3) and individual attribute logic for the columns. Hydes et al shows a repetitive copy operation into a full display refresh buffer (characters), dynamically decoding to actual pixel representations subsequently, on line, by refresh logic. Hydes et al does not accumulate the next band of the composite display as a subimage of actual pixel representations.

U.S. Pat. No. 3,925,776, Swallow, DISPLAY TERMINAL SYSTEM, Dec. 9, 1975, shows a system wherein a display is compactly coded as edge segments (horizontal lines) which are converted to video in real time. Edge segments are held in buffers which group together edges of similar y-coordinate value. The buffers hold coded edge information, not pixels. Multiple buffers permit a hierarchy of edge definitions which permit a 2D display to create the illusion of 3D. Pixels are developed by two stages of decoding the edge information, using the same technique for new display and for refresh. The Swallow et al buffers have no capability for direct presentation of image data in the format of actual pixels, and alphanumeric data must be described in terms of edges.

U.S. Pat. No. 4,404,554, Tweedy et al, VIDEO ADDRESS GENERATOR AND TIMER FOR CREATING A FLEXIBLE CRT DISPLAY, Sept. 13, 1983, shows a row buffer, but for coded data, not pixel data. In the Tweedy et al specification, character codes are stored in a line buffer so that as each raster line is generated the character codes can be quickly retrieved. This differs from the BAND BUFFER DISPLAY SYSTEM of this patent specification, which needs no correspondence between lines of characters and band buffers, and in which characters may overlap band buffer boundaries because the presentation in the band buffer is in the format of actual pixels.

U.S. Pat. No. 4,454,507, Srivanasan et al, REAL-TIME CURSOR GENERATOR, June 12, 1984, shows a real-time video generator in which control words cause sequences of pixels to be generated and merged with other video. Such generation does not relate to "bands," nor does it relate to the essential operation of the BAND BUFFER DISPLAY SYSTEM of this patent specification, which is to copy images from a library, to assemble a swath of a picture in a band buffer, and to transmit at high speed a stream of video pixels to create or to refresh a display.

U.S. Pat. No. 4,146,879, Nicholson et al, VISUAL DISPLAY WITH COLUMN SEPARATORS, March 1979, shows two row buffers in a system having column separator lines displayed as an operator aid, between character matrix positions.

U.S. Pat. No. 4,217,577, Roe et al, CHARACTER GRAPHICS COLOR DISPLAY SYSTEM, August 1980, shows the use of multiple character buffers, one for each color, in a color graphic display system.

U.S. Pat. No. 4,232,376, Dion et al, November 1980, RASTER DISPLAY REFRESH SYSTEM, shows a raster display refresh system in which picture elements are stored in raster scan sequence in a small random access memory. Whenever a picture element address in the data register of the random access memory equals the video address, a corresponding new picture element is substituted for the old picture element previously circulating in the refresh memory.

U.S. Pat. No. 4,237,543, Nishio et al, MICROPROCESSOR CONTROLLED DISPLAY SYSTEM, December 1980, shows a video display system refresh memory sectioned by byte with an upper byte memory and a lower byte memory. A microprocessor controls the display system so as to provide selective access to the display register.

U.S. Pat. No. 4,342,051, Suzuki et al, METHOD OF AND SYSTEM FOR REPRODUCING OR TRANSMITTING HALF-TONE IMAGES, July 1982, shows a method of producing halftone images by means of a number of selecting circuits for each of several line paths.

U.S. Pat. No. 3,999,168, Findley et al, INTERMIXED PITCHES IN A BUFFERED PRINTER, December 1976, shows a printing technique for providing variable pitch characters. Findey et al uses an intermediate buffer as a print line buffer and also a compression algorithm, a page buffer, a modification data buffer and a pair of line buffers. The compressed graphic code bytes in the page buffer are decompressed by a decompression algorithm which is the reverse of the compression algorithm and are passed, together with data from a modification data buffer, to one of the pair of line buffers. The modification data buffer stores data used in making minor changes between copies when plural copies of the same page are to be printed.

U.S. Pat. No. 4,367,533, Wiener, IMAGE BIT STRUCTURING APPARATUS AND METHOD, January 1983, shows a set of line buffers multiplexed into a printer in a technique for structuring printed characters.

D. A. Canton, IMPLEMENTATION OF REFRESH MEMORY IN MICROPROCESSOR-CONTROLLED DISPLAYS, IBM Technical Disclosure Bulletin, Vol. 25, No. 2, July 1982, p. 843, shows the use of two random access memories and a buffer cache to provide a continuous refresh logic for a display.

P. A. Beaven et al, PROGRAMMABLE SYMBOLS TECHNIQUE FOR RASTER-SCANNED DISPLAY, IBM Technical Disclosure Bulletin, Vol. 25, No. 2, July 1982, pp. 844–845, shows the use of a single store made up of character slices with a two part load-/unload buffer.

F. C. Crow, et al, A FRAME BUFFER SYSTEM WITH ENHANCED FUNCTIONALITY, Computer Graphics, Vol. 15, No. 3, August 1981, pp. 63–69, shows a frame buffer system in which comparisons between incoming and stored data are used to implement conditional writes. Update and refresh ports are designed for a simultaneous use by separate tasks. By providing the frame buffer with an arithmetic logic capability, but no program storage or sequencing, Crow et al removes some computational load from the processor. All changes to the image are made through data registers at a single update port. Old data and new data are blended by a blending function downstream from the frame buffer. The frame buffer system was designed for quick turnaround of animation sequences. The frame buffer can be used to store four full frame pseudo color images, sixteen quarter frame images or even sixty-four sixteenth frame images. These can be presented to the video tape at full speed by synchronously updating the frame buffer output control.

SUMMARY OF THE INVENTION

The invention provides a video display in which the actual signals applied to the video raster are provided on a serial pixel by pixel and line by line basis, which is the simplest video presentation, from a plurality of successively active band buffers. The video data for a plurality of horizontal lines is generated and stored in the next band buffer; subsequently this first band buffer is read out for display while data is being generated and stored in an alternate second band buffer. In this fashion, the video raster is developed band by band in succession.

Multi-viewport composite video display, for example of a picture with superimposed text, is accomplished by successive transfer of the pictorial and textual data to a band buffer, for transfer at the appropriate time to the video shift register.

The band buffer in turn is loaded from an image memory according to selection information from a display list memory. A band buffer assembly register may be used to reduce the number of accesses to the band buffer.

It is the object of the invention to build up a video band image within one band buffer, using a band display list which is stored in the display list memory, designating subpictures to be extracted from image memory, and then forwarding the band image for display.

An advantage of the invention is that it may be used with displays or printers of standard types and with all-points-addressable display/printer systems.

Another advantage of the invention is that picture components can be moved in the composite picture without moving their pixel representations, simply by changing the X-Y values in the display list memory.

BRIEF DESCRIPTION OF THE DRAWINGS

FIG. 8 is a composite diagram (FIGS. 8.1 and 8.2) explaining links and viewports.

DETAILED DESCRIPTION OF PREFERRED EMBODIMENT

Figure 1:
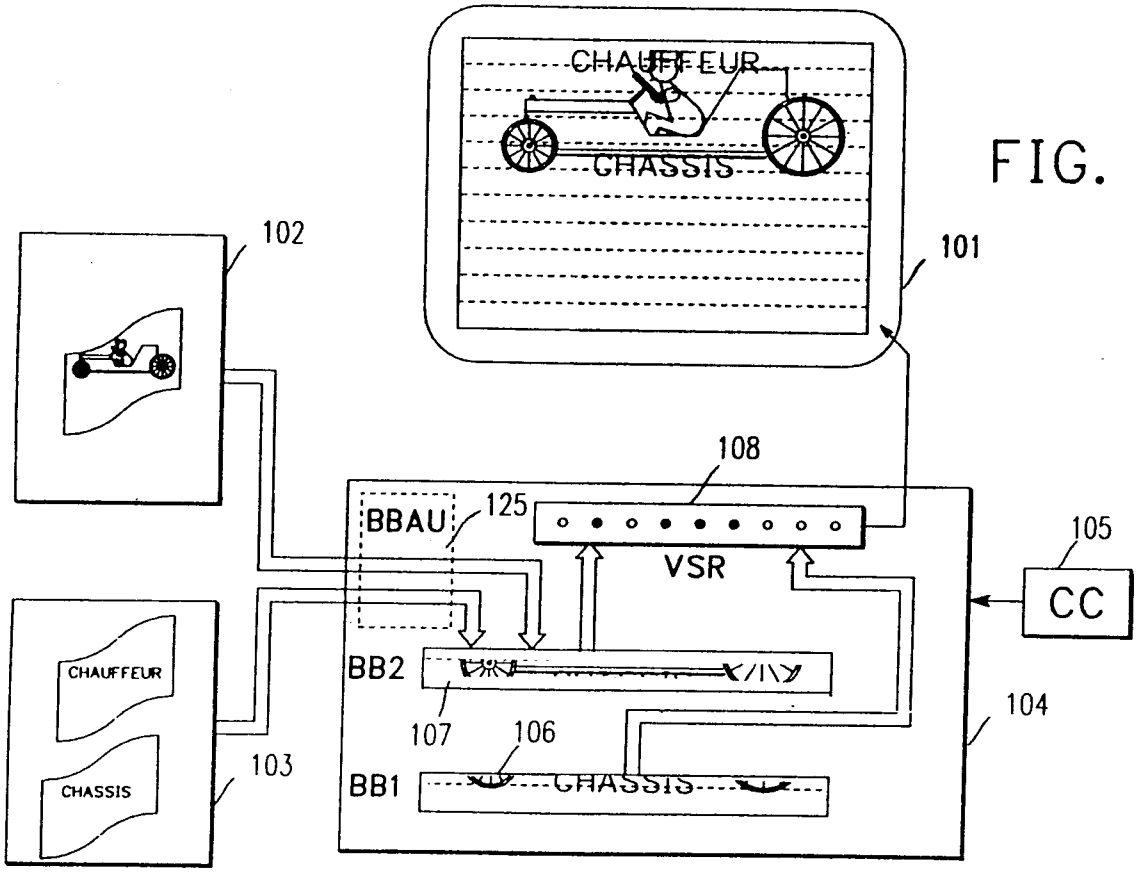
FIG. 1 is an overall system diagram showing how multiple picture components can be superimposed according to the invention.
Figure 2:
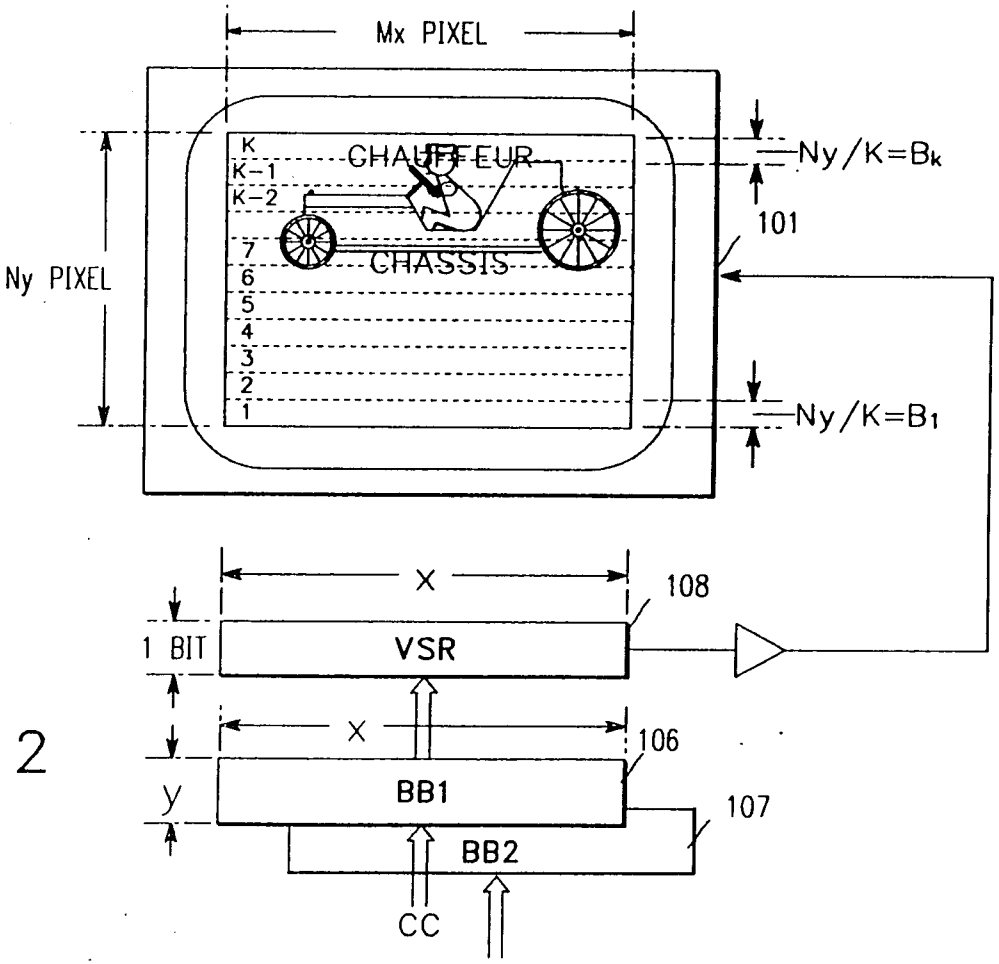
FIG. 2 is a simplified schematic diagram of the band buffer presentation to the video display.

FIGS. 1 and 2 illustrate the band buffer of this invention. The band buffer unit functions to build up a pattern of pixel data bits, equivalent to a video band (where K video bands make up the video raster), and thereafter functions to provide those pixel data bits to a video shift register for presentation to the video device. Where the video raster is N pixels vertically and M pixels horizontally, the full screen of N×M pixels is built up sequentially in K bands of $(^N/_k)\times M$ pixels each.

FIG. 1 illustrates how picture components are provided to the display. The display 101 is provided with the image of an automobile, for example, by image memory 102, and with text words by character generator 103.

The image and character composite display is built up, band by band, in band buffer unit 104 under control of control unit 105.

Band buffer unit 104 in turn contains two or more band buffers, including BB1 (106) and BB2 (107) which are controlled to be accessed alternately. The accessed band buffer is loaded in parallel from image memory 102 and character generator 103.

The band buffer is then used as a source register for video shift register VSR 108 to provide the several lines of pixel data appropriate to the stored band. At the same time, the next band can be fed to the other band buffer. The band buffers thus alternate to provide band data to display 101 via VSR 108.

FIG. 2 shows more detail of the band buffers 106, 107, VSR 108 and display 101 as regards the composite display. In the simple composite shown in FIGS. 1 and 2, the words chauffeur and chassis are included with the picture of an automobile with driver.

The various size relationships are shown in FIG. 2. Display unit 101 is arranged with a finite number K of bands 1,2,3,4,5,6,7 . . . (K-2), (K-1), K.

The display is a raster of N×M pixels with N pixels in the Y dimension and M pixels in the X dimension. Each band is (N/K)×M pixels; for clarity the dimensions of BB1 and BB2 are shown as Y×X bits. The dimensions of VSR 108 are 1×X bits.

The band buffer receives complex control information from the copy controller, which may be actually controlling the production of multiple viewport pictures which the band buffer accumulates simply as video coded picture elements (pixels). Pixels may be complex multi-unit picture elements requiring many bits for definition. In the preferred embodiment, for simplicity and understanding, a single bit binary pixel is used. The size of each band buffer is $^N/_k$ bits tall and x bits across, which in the preferred embodiment is equivalent to a horizontal band $^N/_k$ bits high across the entire width of the video raster.

It has been pointed out that a key technical problem is provision for a quick update when either the content of the application's graphical window changes or the arrangement of viewports in the picture changes.

This embodiment is based on the concept of a repetitious copy operation, done at full refresh rates, from an image memory to a band buffer, from which band buffer the video to refresh the display is derived. The essential difference between this system and an intrabuffer copy operator such as BITBLT lies in its continuous repetitive nature, and the interbuffer copy from an image memory to a band buffer.

The concept of the band buffer is illustrated in FIG. 2. Serial video (to refresh one raster line) is shifted out of a parallel-in unidirectional-shiftout video shift register. This shift register is loaded in parallel from the band buffer, which contains $^N/_k$ raster lines of video information. The band buffer is in turn loaded in parallel by the copy controller, not shown. At any one time, the band buffer contains the video information for one band of the raster.

Figure 3:
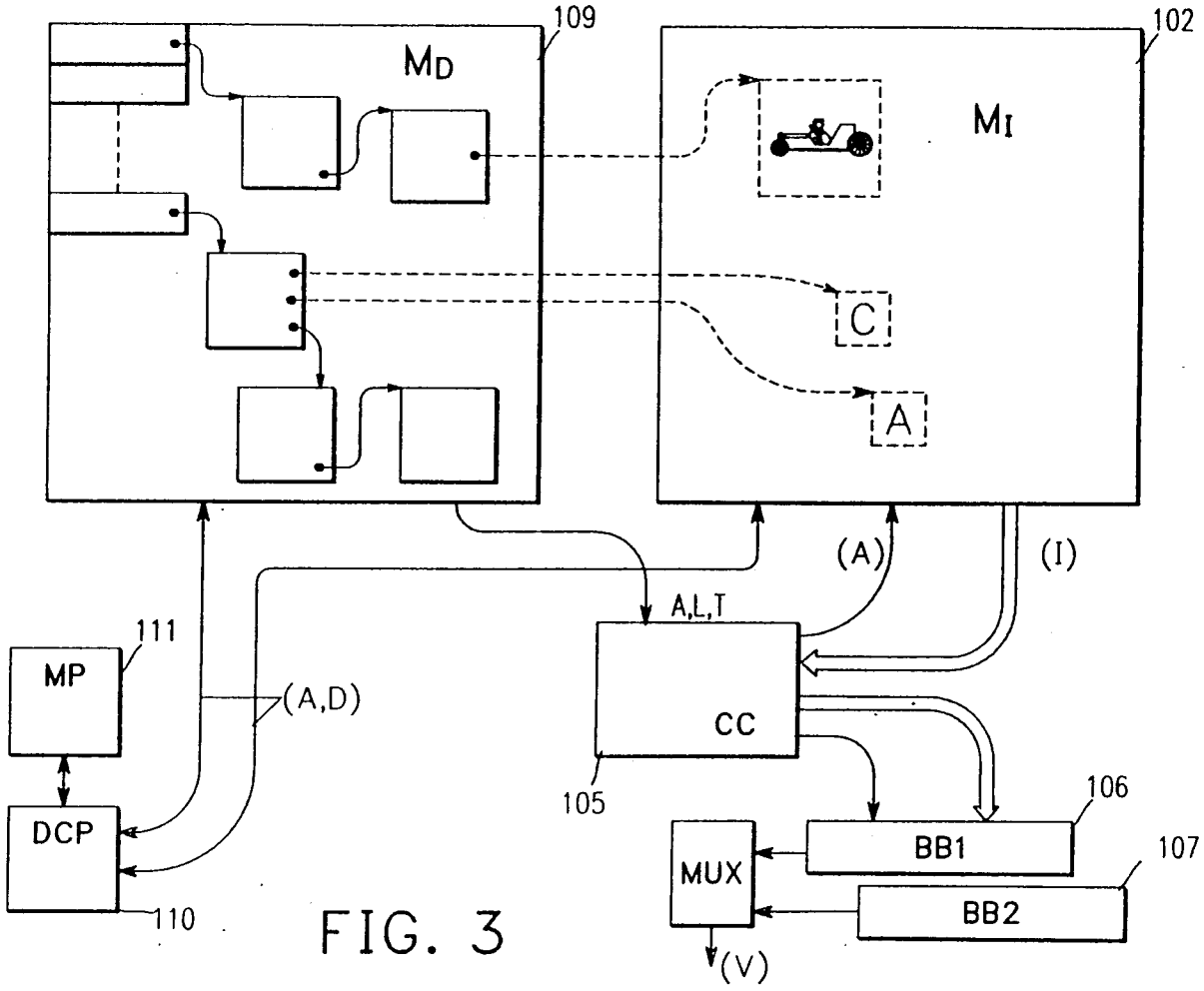
FIG. 3 is a diagram of the copy controller.

FIG. 3 shows a system consisting of the copy controller (CC) 105, two band buffers (BB1, BB2) 106, 107, an image memory (MI) 102, a display list memory (MD) 109, and a display control processor (DCP) 110, with its own private memory (MP) 111. Under some circumstances the display list memory and the private memory of the display control processor can be combined. Two band buffers are shown, so that one can be filled by the copy controller while the other is being emptied to derive serial video.

Figure 4:
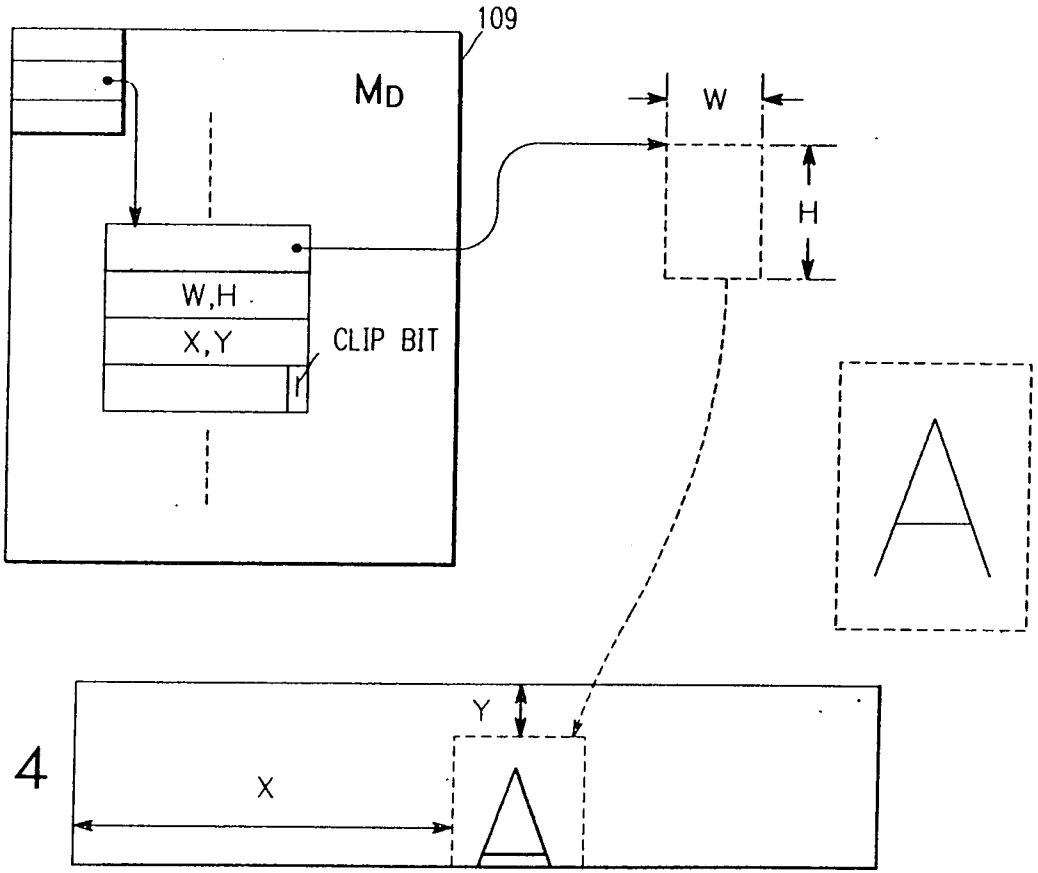
FIG. 4 is a diagram illustrating copying and clipping procedures.

The operation of the copy controller can now be described with respect to FIGS. 3 and 4. The copy controller (CC) 105 first fetches an image descriptor from the current band display list (see FIG. 4) in (MD) 109. This descriptor is shown as a four-word block containing information about an image in image memory (its address, height H, and width W) and where the image is to be placed in a band. There is one band display list per band in the display list memory. The image descriptor also contains a CLIP flag bit which indicates whether or not the image is to be clipped to a rectangular boundary. For the moment, assume no clipping is required.

The display image and any superimposed characters are unlikely to be fully contained within a given band. FIG. 4, for example, shows that only the top portion of the character "A" being placed in the band buffer falls within the band. Processing of the MD data describing the character "A" is carried out under control of the copy controller CC as shown in FIG. 4.

Once the copy controller has obtained the image descriptor block it analyzes this information and sets up a transfer from image memory to the band buffer. This operation is closely analogous to a DMA (direct memory access) memory-to-memory move operation. The image memory requires an address and a function (always FETCH) for each word transfer. The band buffer requires an address, a function (always STORE), and a write mask for each word transfer. The write mask specifies which bits of the band buffer word are to be stored; the other bits in a band buffer word are not affected. The purpose of the copy controller is then to:

(a) fetch and analyze an image descriptor;

(b) derive the image memory starting address;

(c) derive the band buffer starting address and write mask;

(d) initiate an image memory fetch;

(e) initiate a band buffer store;

(f) update image memory and band buffer parameters and do steps d and e until the transfer is complete.

Figure 5:
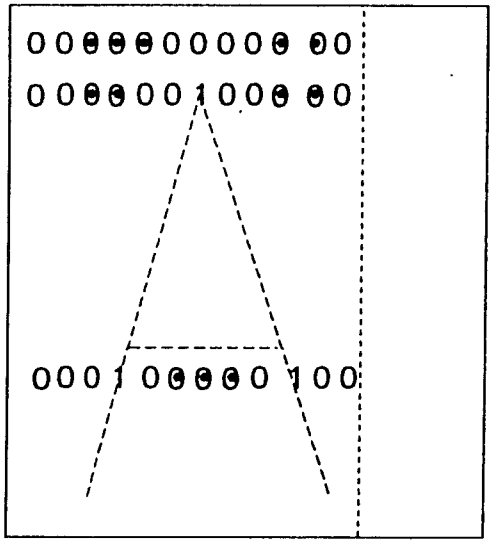
FIG. 5 is a diagram illustrating typefont storage.

Once a single word has been transferred from image memory to the band buffer, new parameters for the next word transfer must be derived by the copy controller. These parameters depend on the way images are stored in the image memory. For example, suppose that a character font matrix is stored in image memory as shown in FIG. 5, then the next image memory address is just the current address plus one.

Figure 6:
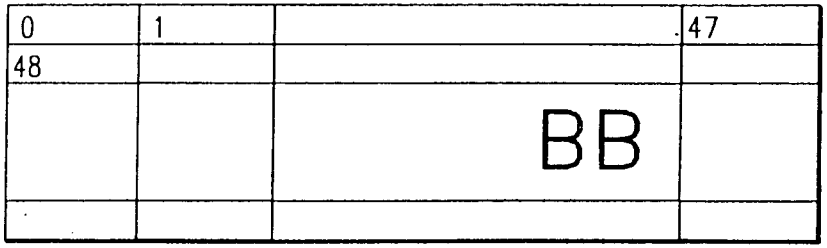
FIG. 6 is a diagram illustrating band buffer mapping.
Figure 9:
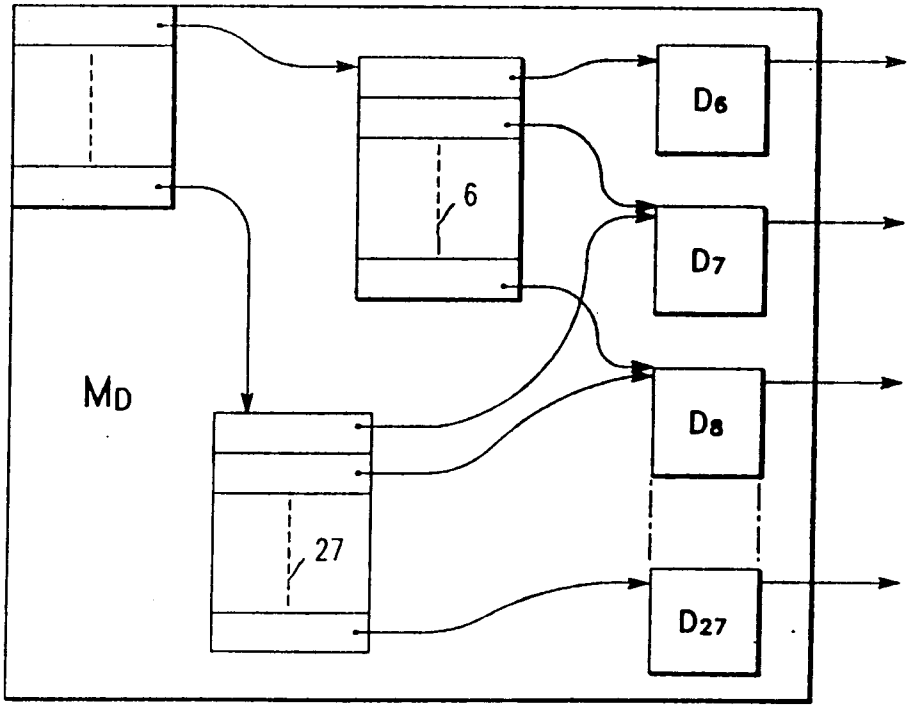
FIG. 9 is a diagram showing alternate forms of display lists in the display list memory.

The format (or mapping) of the band buffer determines the write mask and the way that the next band buffer address is determined. Suppose that the word addresses are assigned in the band buffer as in FIG. 6, then the next band buffer address is just the current address plus 48, provided the X offset (see FIG. 9) is a multiple of 16 and band buffer words are 16 bits long.

It is seen, then, that for an X offset of 128 and a Y offset of 4, the band buffer starting address is $$((4-1)\times 48)+(128/16)=152$$

and the next band buffer address is the current one plus 48. The write mask for this example is:

1111111111110000.

In order to accommodate the situation where the X offset is not a multiple of 16, the copy controller must shift the output of the image memory and may have to store twice in the band buffer. For example, if the X offset were 122, then for each word fetched from image memory the copy controller would store into two successive locations in the band buffer, first with a write mask of:

0000000000111111 and a right shift of 10, and then with a write mask of:

1111110000000000 and a left shift of 6.

If the clipping of the image is required in order to confine the image to a viewport (or for any other purpose) the copy controller can limit the information to be copied. In FIG. 4, for example, an "A" is shown clipped on all four sides. If the CLIP bit of the image descriptor is set, the image descriptor would be extended to contain the clipping parameters XSTART, YSTART, WIDTH, and HEIGHT. YSTART would normally affect only the starting address in image memory, and addresses generated to the band buffer. In the running example of FIGS. 4, 5 and 6, if the X offset were 128, and the clipping parameters were XSTART=5, YSTART=2, WIDTH=4, and HEIGHT=13, then the starting address in the image memory would be two greater than in the previous case and the write mask would be 0000011110000000.

Note that the X and Y offsets in the image descriptor can be negative, but that the clipping parameters are all positive.

The role of the display control processor in this system is twofold:

(1) to maintain display lists, one for each band, in the display list memory; and (2) to maintain images in the image memory.

The display list memory must be addressable directly by the display control processor to permit picture rearrangement, and may in fact be a portion of the memory of the display control processor.

Access by the display control processor to image memory can be on a word-by-word basis or on a block transfer basis. The latter is recommended because it simplifies the circuitry for sharing the relatively high speed image memory between the copy controller and the display control processor. If block transfer is selected then the transfer can be asynchronous with respect to the display control processor. The demands of the copy controller would take precedence over those for the block transfer to minimize disturbances of the picture, unless a massive update of image memory contents were desired, in which case the display control processor could set a flag which would control the arbitration circuitry for the image memory.

Figure 7:
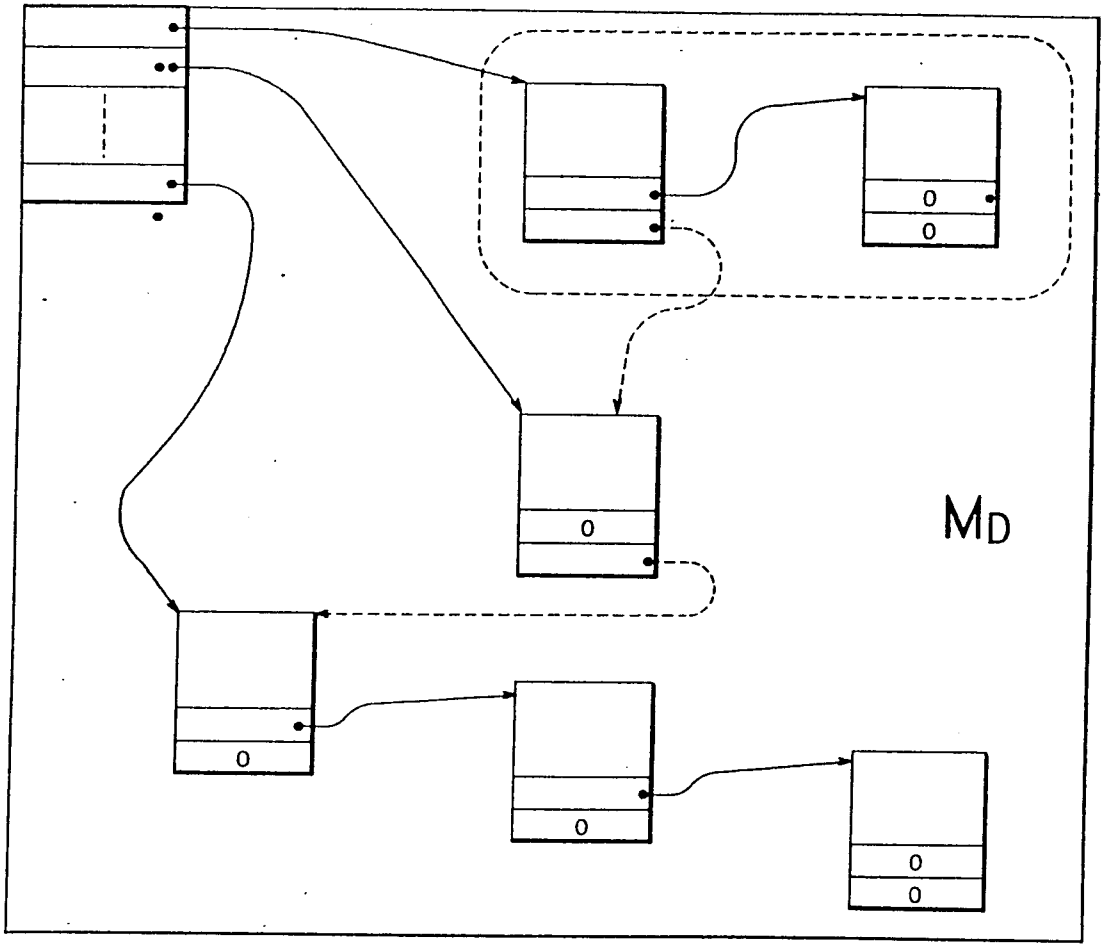
FIG. 7 is a diagram showing band buffer link structure in the display list memory.

A structure for band display lists is shown in FIG. 7. In FIG. 7, reserved locations in display list memory (MD) contain the addresses of the various band display lists. Each of the band display lists is, in turn, made up as a linked list of display list segments, each of which contains image descriptors.

The purpose of this structure is to allow the copy controller fast access to display control data and to allow the display control processor to change that data quickly. The dotted links in FIG. 7 chain display list segments for use by the display control processor. To see how this linked structure is used, consider the multiviewport examples of FIG. 8.1 and FIG. 8.2, which respectively show the display configuration and storage pattern in display memory MD.

Here, the picture in bands I, I+1, I+2 consists of two overlapping viewports V1 and V2. V1 consists of three rectangular areas; V1A, V1B, and V1C; V2 also consists of three rectangular areas V2A, V2B, and V2C. The display list memory contains display list segments for each of these areas. All the blocks for a band are linked by the solid links; all the blocks for a viewport are linked by the dashed links. The solid links are used by both the display control processor and the copy controller, while the dashed links are used only by the display control processor to determine which display list segments constitute a viewport.

An alternate form of the image descriptor is also possible, in which the absolute X and Y coordinates of the upper left corner of the image are given. In this form of the display list the computation of the parameters that control a copy operation involve the copy controller's knowledge of the current band number and the Y coordinate of the first raster line of each band. In this case, all image descriptors for a particular image block are the same, regardless of the band display list in which they appear. In this case the structure of the band display list may be changed as in FIG. 9 below—this structure is more compact and easier to update, but copy transfer parameters are somewhat harder to derive. The X offset field is unchanged, but the Y offset must be computed by subtracting the band height times the band number from the absolute Y coordinate.

Figure 10:
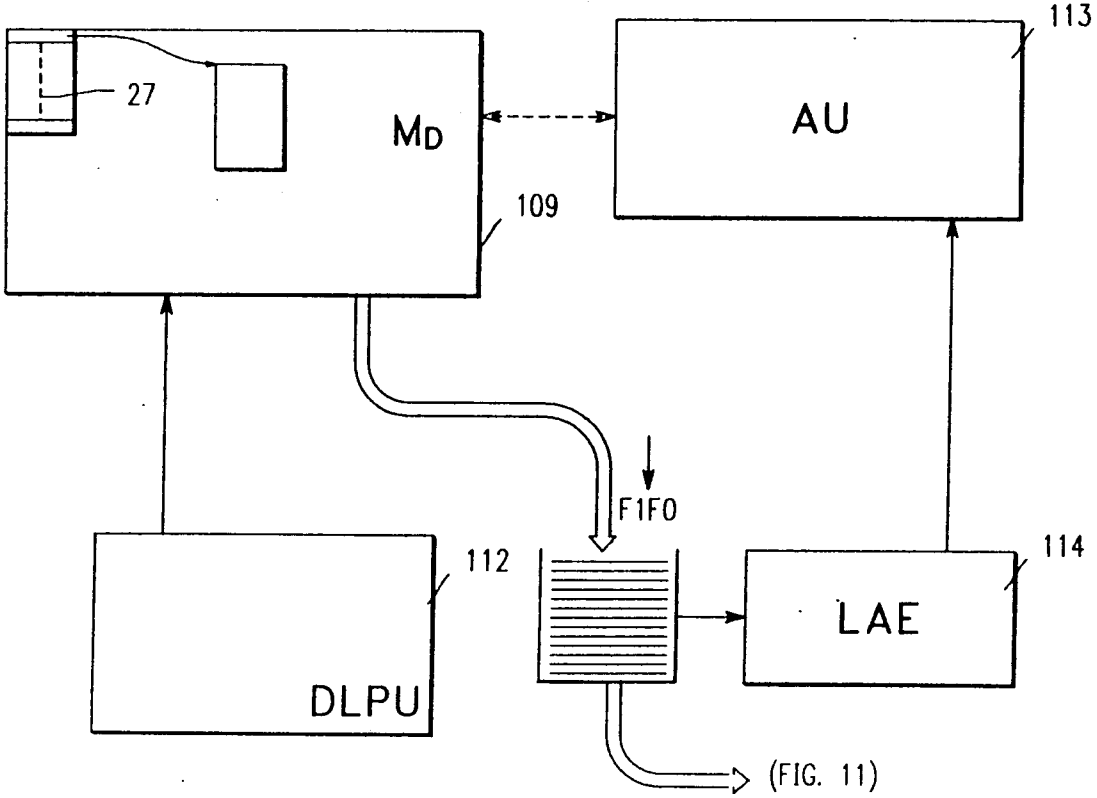
FIG. 10 is a diagram illustrating display list prefetch unit operation.
Figure 11:
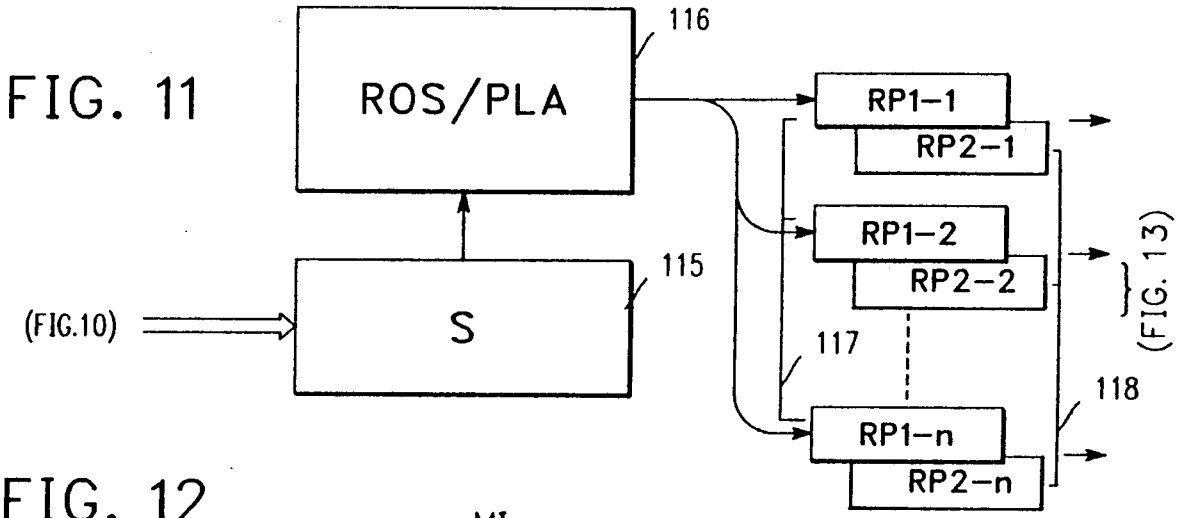
FIG. 11 is a diagram of the parameters determination unit.
Figure 13:
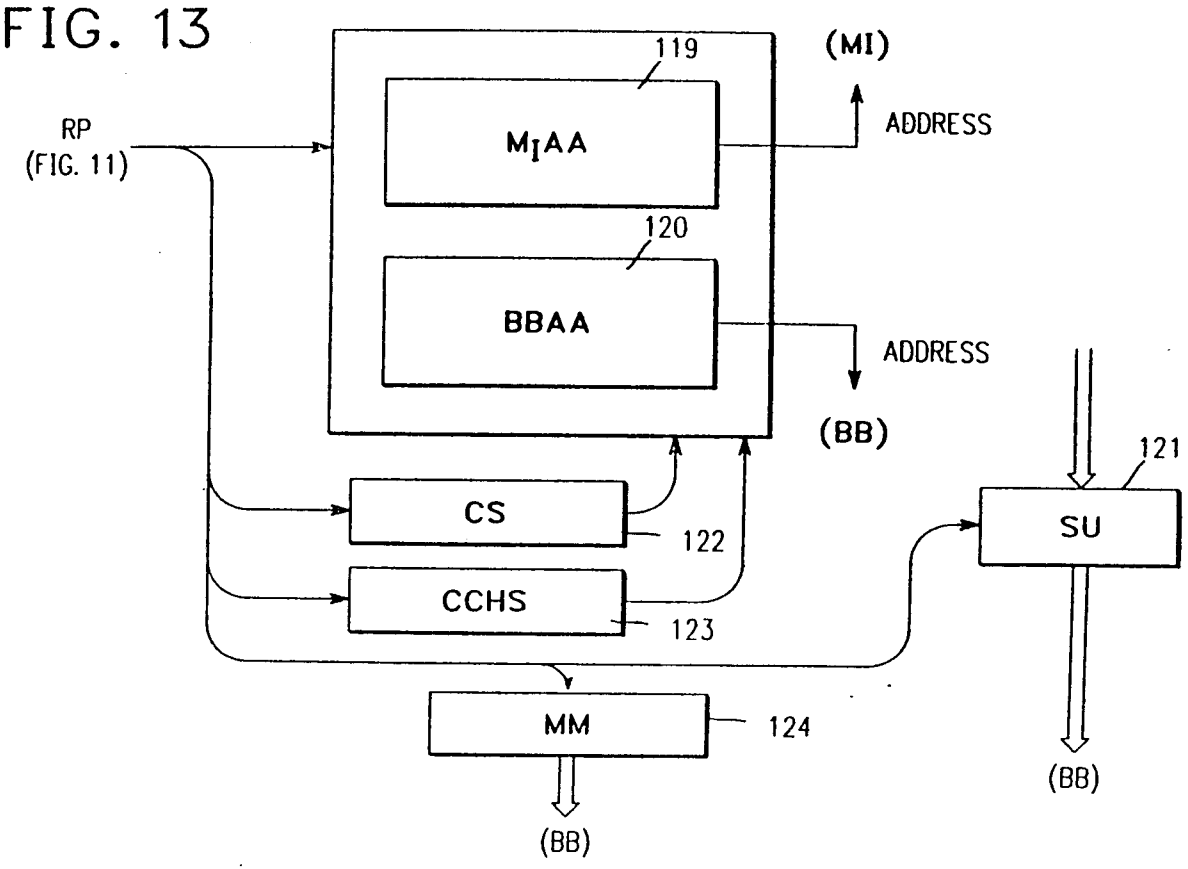
FIG. 13 is a diagram of copy transfer data flow.

The internal structure of the copy controller is shown in FIGS. 10, 11 and 13. FIG. 10 shows the display list prefetch unit, whose purpose is to supply a continuous stream of image descriptors to the parameter determination (FIG. 11) component. The display list prefetch unit (DLPU) 112 has responsibility for locating a band display list given a band number. This is done through the reserved locations in display list memory. Additionally, the DLPU follows the link from one display list segment to another.

The output of the DLPU is a first-in-first-out list of image descriptors. Additionally shown in FIG. 10 is a function block which determines relative list occupancy, increasing the priority of accesses to the display list memory when the supply of image descriptors to the parameter determination component runs low. Arbitration unit (AU) 113 signals display memory (MD) with a higher priority when list-almost-empty unit (LAE) 114 determines that the first-in-first-out list is almost empty.

FIG. 11 shows the structure of the parameter determination unit of the copy controller, whose purpose is to interpret image descriptors and derive the actual parameters of a transfer. The mechanism of FIG. 10 supplies a FIFO stream of image descriptors from display memory (MD) 109 (FIG. 10) to image descriptor source register (S-FIG. 11) 115. Register S provides address information to ROS/PLA 116, to invoke previously stored parameter data. Parameter data words are transferred to the appropriate one of two alternate sets of parameter registers 117 or 118, which may be considered odd cycle parameter registers and even cycle parameter registers, respectively.

Figure 12:
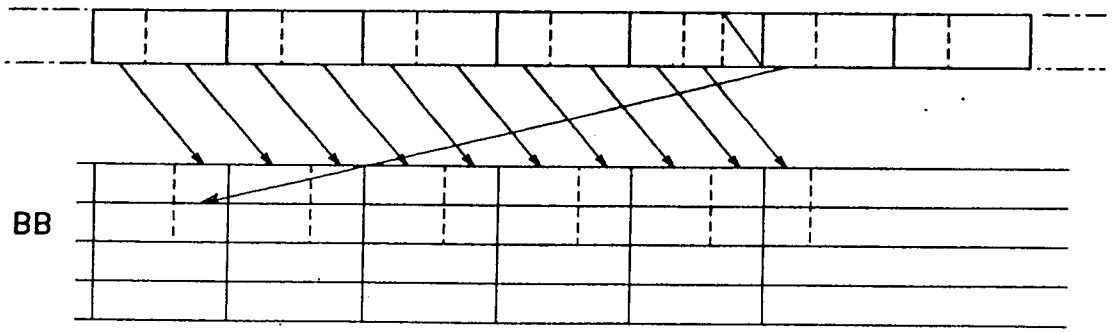
FIG. 12 is a diagram illustrating slice transfer in the image memory.

FIG. 12 illustrates shifting.

As in the example described previously, the parameter determination unit must supply parameters relating to image memory address sequences, band buffer address sequences, write masks, and shift specifications to the copy transfer dataflow of FIG. 13. Each transfer consists of the transfer of a number of horizontal slices of an image. The pattern of addresses generated and the write masks and shift counts are the same for each slice. Specifically, with reference to FIG. 12, each slice transfer is specified by:

- a starting image memory word address;
- a starting band buffer word address;
- a left-part word shift specification and write mask;
- a right-part word shift specification and write mask;
- a last-part word shift specification and write mask; and
- a number of transfers.

In FIG. 12, an image is being shifted to a non-word boundary in the band buffer, and the horizontal slice of the image is not an integral number of words long. The transfer of the left part of an image memory word requires a different shift specification and write mask than the right part. The last-part shift specification is the same as either the left-part or the right-part (depending on where in the image memory word the last part resides), while its write mask may be unique. In addition to the parameters for a slice transfer additional parameters are needed to determine the number of slices transferred and the image memory address increment.

The determination of parameters given an image descriptor is straightforward and can be implemented in either a programmable logic array (PLA) or a read-only memory. Two sets of parameter registers are shown in FIG. 11 to permit determination of the parameters of the next transfer while one is in progress.

FIG. 13 shows the copy transfer dataflow component of the copy controller. This component consists of an image memory address adder (MIAA) 119 for the image memory and a band buffer address adder (BBAA) 120 for the band buffer, a shift unit (SU) 121 and controls including both a slice counter (CS) 122 and a horizontal slice cycle counter (CCHS) 123. Note that in case an image is clipped the address increment to image memory at the end of a slice may not be 1; the address increment to the band buffer at the end of a slice is generally not 1. The mask multiplexer (MM) 124 selects the left-part mask, the right-part mask, or the last-part mask depending on circumstances.

In order to reduce the number of accesses to image memory (MI) 102 (FIG. 3) the included image memory data register can be used as a holding register. The copy controller invokes a comparator function to determine that the next memory access address is identical to the previous memory access address. In this case, if the copy controller (CC) 105 (FIG. 3) generates the same address to image memory twice in succession, no actual access is made the second time; the contents of the image memory data register can be used directly. The copy controller bypasses the access to image memory 102 when the next memory access address is identical to the previous memory access address.

The image memory, which can be changed by the display controller, is disturbed only for one refresh cycle when it is being changed. Such temporary disturbances can be tolerated in displays.

For practical purposes, the image memory is only read—never written. The data stored in it, therefore, does not change between successive accesses, for practical purposes. It is thus possible to avoid unnecessary references to image memory when a second access is made to the same location, by simply making multiple references to the data previously read out from image memory.

In order to reduce the number of accesses to the band buffers, a "band buffer assembly unit" can be introduced in Band Buffer Unit 104 (FIG. 1). FIG. 1 illustrates the band buffer assembly unit which is set by transfer operations; data is written into the band buffer only when the band buffer address changes or when a transfer is complete. The copy controller bypasses writing into the band buffer unit 104 except when the band buffer address changes or when a transfer is complete. A second register (the "write mask assembly register") contains the logical OR of the write masks for a single band buffer address.

As an example, consider the case of FIG. 12 and assume that the first image memory address is I1 and that the first band buffer address is B1. First, the copy controller accesses I1 and shifts the data right into the band buffer assembly register, setting the write mask assembly register to the write mask (0 . . . 01 . . . 1). Then the copy controller determines that the next band buffer write operation will be to B2 so the band buffer assembly register contents are written into B1 with the control of the contents of the write mask assembly register. Now the next image memory access is to I1, so the fetch is suppressed and the left part of the image memory data register is written to the band buffer assembly register. The write mask assembly register is set to 11 . . . 10 . . . 0. No fetch is made from image memory; no store is made to the band buffer. Next, the image memory is accessed at I+2. The band buffer assembly register is written and the write mask assembly register is ORed with 00...01...1 (and thus set to all ones). At this time the copy controller determines that the next band buffer address is B3, and so stores the entire contents of the band buffer assembly register into B2.

Various configurations of bands may be configured into a band buffer display system without departing from the spirit and scope of the invention, as pointed out in the following claims.

What is claimed is:

1. A composite display system of the multi-port type, having a composite display as a primary display selectively modified by one or more superimposed or inset secondary displays, the composite display being a video raster including K multiple-line video bands, the system having video input means matched to the display, and having a source of pixel representations for the primary display, the system comprising:

(a) band buffer means including at least a temporarily assigned "next" band buffer for accumulating a band of the composite display as a plural line subimage of actual pixel representations;

(b) image memory means for providing to said band buffer means actual pixel representations of the secondary display;

(c) display list memory means, for storing the addresses in said image memory means of various segments of display data stored in said image memory;

(d) data address storage means, for storing the addresses of data in said display list memory means so as to derive addresses for a composite display;

(e) gating means for gating pixel representations from predetermined locations in said image memory means, called for by said display list memory means according to addresses specified by said display list memory means and said data address storage means, to storage locations in said band buffer means, whereby said "next" band buffer accumulates pixel representations for an assigned band of the composite display;

(f) transfer means for transferring the accumulated pixel representations from the band buffer means to the video input means; and (g) control means to control said gating means and said transfer means to accumulate in said "next" band buffer the pixel representations for a band of the composite display, and to control said transfer means to transfer the pixel representations accumulated in said "next" band buffer to the video input means.

2. A composite display system according to claim 1, wherein said band buffer means comprises a plurality of band buffers, each storing a plural line subimage, including a temporarily assigned "current" band buffer and one or more temporarily assigned "next" band buffers, and wherein said control means effectuates said one or more next band buffers of said band buffer means to accumulate the pixel representations of the appropriate next band and concurrently effectuates said current band buffer of said band buffer means to transfer the pixel representations previously accumulated in said current band buffer while said current band buffer was temporarily assigned as next band buffer.

3. A composite display system according to claim 1, wherein said image memory means includes a memory data register for loading said band buffer means, wherein said control means includes means to detect a sequence of image memory read operations directed to the same image memory access address, and wherein said control means also includes means responsive to said detecting means to load said band buffer means directly from the memory data register of said image memory means rather than from said image memory means.

4. A composite display system according to claim 2, wherein said control means includes means to sense completion of transfers and band buffer address changes and includes means to bypass writing into the band buffer except when the band buffer address changes or when a transfer is complete.

* * * * *